United States Patent [19]

Werych

[11] 4,300,882

[45] Nov. 17, 1981

[54] INDUSTRIAL FURNACE WITH SIDE WALL CERAMIC INSULATING MODULES

[75] Inventor: Ewald R. Werych, Elm Grove, Wis.

[73] Assignee: General Signal Corp., Stamford, Conn.

[21] Appl. No.: 170,960

[22] Filed: Jul. 21, 1980

Related U.S. Application Data

[62] Division of Ser. No. 50,547, Jun. 21, 1979, Pat. No. 4,246,852.

[51] Int. Cl.[3] ..... F27D 1/00

[52] U.S. Cl. ..... 432/247; 266/286; 432/252

[58] Field of Search ..... 432/247, 248, 249, 252; 110/331, 332, 336, 339; 266/280, 283, 286

[56] References Cited

U.S. PATENT DOCUMENTS

| | | | |
|---|---|---|---|
| 2,144,598 | 1/1939 | Brinckerhoff et al. | 110/336 |
| 3,591,152 | 7/1971 | Mills, Jr. | 432/247 |
| 3,832,815 | 9/1974 | Balaz et al. | 110/336 |
| 3,892,396 | 7/1975 | Monaghan | 110/336 |
| 3,940,244 | 2/1976 | Sander et al. | 110/336 |
| 3,953,009 | 4/1976 | Kan | 266/283 |
| 4,011,394 | 3/1977 | Shelley | 110/336 |
| 4,083,155 | 4/1978 | Lampert | 110/331 |
| 4,246,852 | 1/1981 | Werych | 432/247 X |

FOREIGN PATENT DOCUMENTS

| | | | |
|---|---|---|---|
| 927182 | 5/1963 | United Kingdom | 432/252 |

*Primary Examiner*—John J. Camby

*Attorney, Agent, or Firm*—Parmelee, Johnson, Bollinger & Bramblett

[57] ABSTRACT

An industrial furnace with insulating walls comprising side-by-side pre-formed panels each including a plurality of ceramic insulating modules. The side wall panels include vertical buckstays to which the modules are secured by retainer clips including sharp spikes inserted into side edge surfaces of the insulating modules. Modules with offset stepped side profiles are disclosed, arranged to provide for ready removal of a single module without disturbing adjacent modules. Atmosphere furnace insulation arrangements also are disclosed utilizing ceramic modules secured to the furnace shell by special retainer clips embedded in side edge surfaces of the modules.

17 Claims, 18 Drawing Figures

20
22
24
26
28
30
32
34
40
42
44

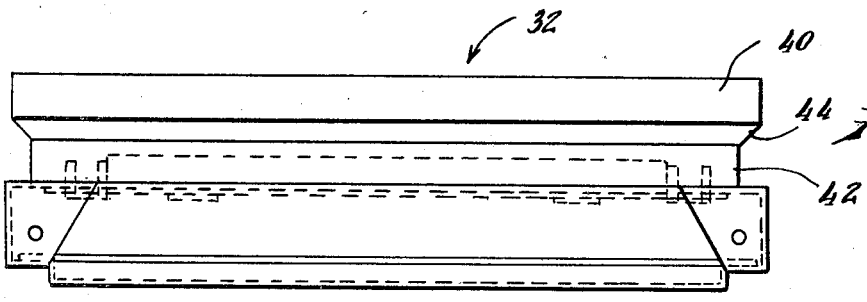
Fig. 5.
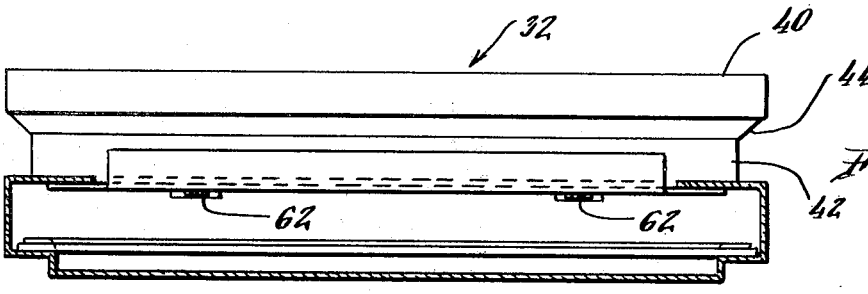
Fig. 6.
Fig. 7.
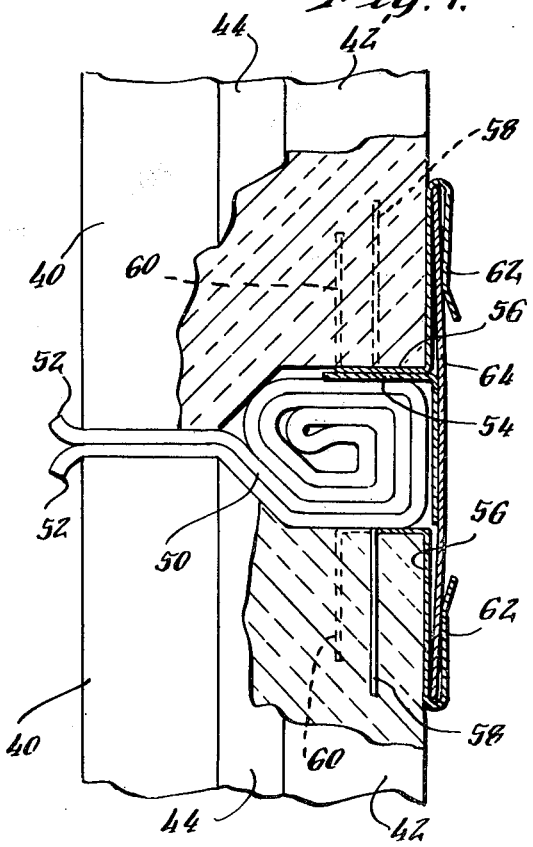
Fig. 8.
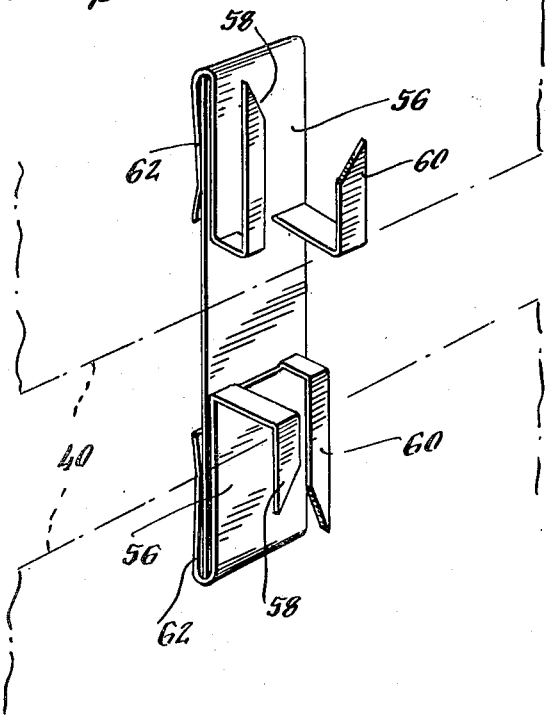

Fig. 9
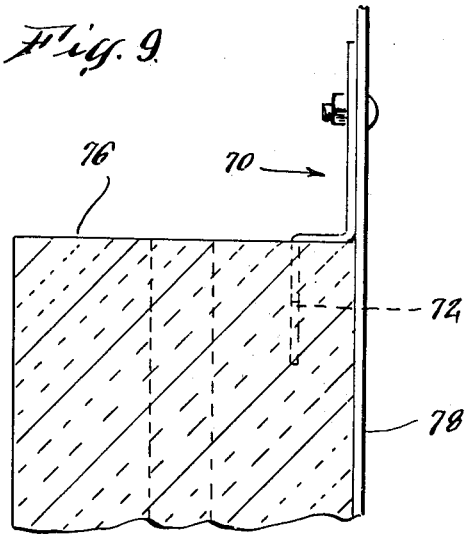
Fig. 10.
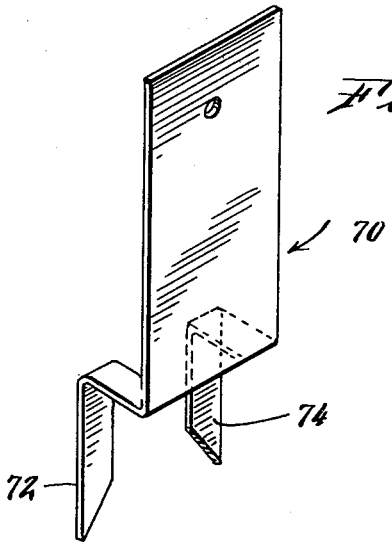
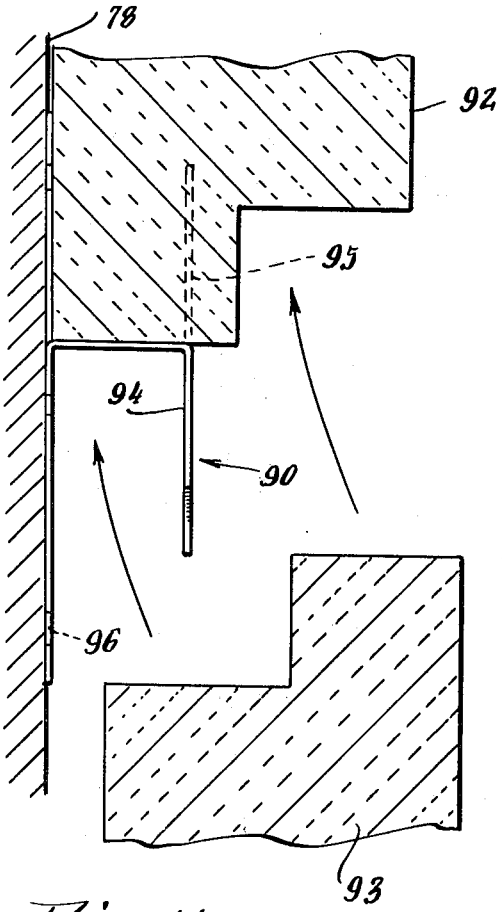
Fig. 11.
Fig. 13.
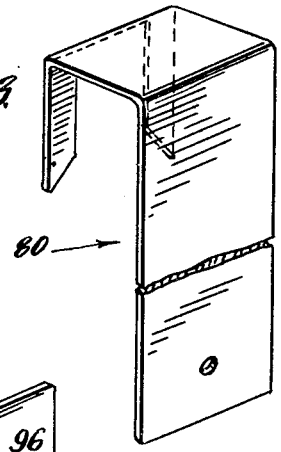
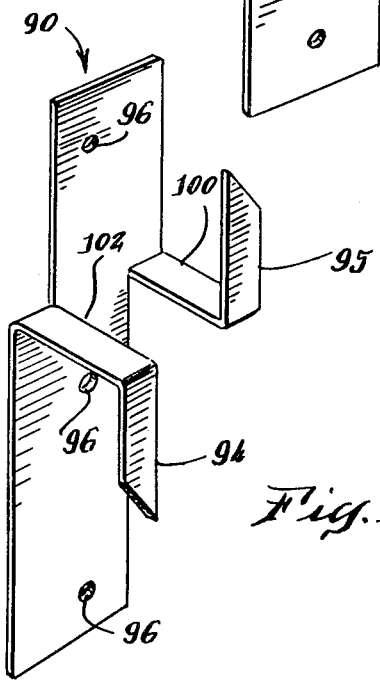
Fig. 12.

INDUSTRIAL FURNACE WITH SIDE WALL CERAMIC INSULATING MODULES

This application is a division of Ser. No. 50,547 filed June 21, 1979, now U.S. Pat. No. 4,246,852.

BACKGROUND OF THE INVENTION

1. Field of the Invention

This invention relates to industrial furnaces used for example in heat treatment processing of material. More particularly, this invention relates to such furnaces employing ceramic fiber insulation in the form of lightweight modules, and specifically is directed to means for securing such ceramic insulation modules in the wall of a furnace, as well as to module configurations especially useful for such purpose.

2. Description of the Prior Art

The use of ceramic fiber modules to insulate high-temperature industrial furnaces is advantageous for various reasons, and especially because such construction affords significant savings in energy compared to the more conventional fire brick typically used for furnace linings. U.S. Pat. No. 3,500,444, issued to W. K. Hesse et al discloses one type of lightweight ceramic module, and describes a vacuum process for molding such a module from a liquid suspension of an inorganic refractory fibrous material. Such modules may have an electrical heating element embedded in situ during the forming process. Alternatively, the modules may be used solely for insulation purposes, as in oil or gas fired furnaces.

Such lightweight ceramic insulation modules do not possess great mechanical strength. For that reason, difficulties have been encountered in securing the modules in place in a furnace. The modules must be held securely in place during many years of use at high furnace temperatures, such as up to 2400° F. Moreover, the module arrangement should be capable of accommodating easy removal and replacement, as for maintenance and repair procedures required in high-temperature furnaces.

Accordingly, it is an object of this invention to provide improved means for mounting lightweight ceramic modules in an industrial furnace. A more specific object of the invention is to provide module arrangements and support means which are capable of reliably supporting a module in the wall of a furnace during long periods of high temperature conditions in the furnace. Other objects, aspects and advantages of this invention will in part be pointed out in, and in part apparent from, the following description considered together with the accompanying drawings.

SUMMARY OF THE INVENTION

In a presently preferred embodiment of the invention, to be described hereinbelow in detail, ceramic furnace wall modules rest upon and are vertically supported by horizontal corss-pieces fastened to vertical buck-stays which provide the mechanical means of structural support for the entire furnace. According to the invention in one of its aspects, the modules are held securely against lateral movement, while resting on the respective cross-piece, by means of special retainer clips inserted into the module interiors through the side surface of each module and fastened to adjacent structural elements.

According to yet other aspects of the invention, the ceramic furnace modules are generally rectangular blocks formed to provide a stepped side edge profile, i.e. being comprised basically of two integral but different-sized slab-like sections formed together as a single unit. The modules are positioned so that the larger sections face towards the furnace interior, and the smaller sections face outwardly. With the outwardly-facing sections being smaller in lateral size, an open region is created between adjacent outer sections and this region is filled with a rolled-up flexible ceramic blanket to prevent heat flow through what would otherwise be a straight-through channel.

According to still further aspects of the invention, L-shaped cross-piece module supports engage the lower edge surface of the smaller module sections to provide vertical support, and pronged retainer clips are inserted into those module sections and secured to adjacent structural elements to hold the modules firmly in place on the cross-piece supports. In other aspects of the invention, multi-layered insulation members are held in place by retainer clips having multiple prongs spaced apart horizontally and, for some applications, offset vertically.

Advantages of the invention include the capability of positively and securely holding ceramic insulating modules in place in a furnace wall, accommodating simple removal of a single module without disturbing adjacent modules, and providing for erection in situ quickly and economically.

BRIEF DESCRIPTION OF THE DRAWINGS

FIG. 5 is a plan view showing the upper end of the module panel;

FIG. 6 is a horizontal section taken along line 5—5 of FIG. 3;

FIG. 7 is a detail vertical section showing the ceramic blanket in place between two ceramic modules;

FIG. 8 is a perspective view of a retainer clip as used with the modules shown in FIG. 6; and FIGS. 9 through 18 show still other retainer clip arrangements.

DESCRIPTION OF PREFERRED EMBODIMENTS

Figures 1, 2:
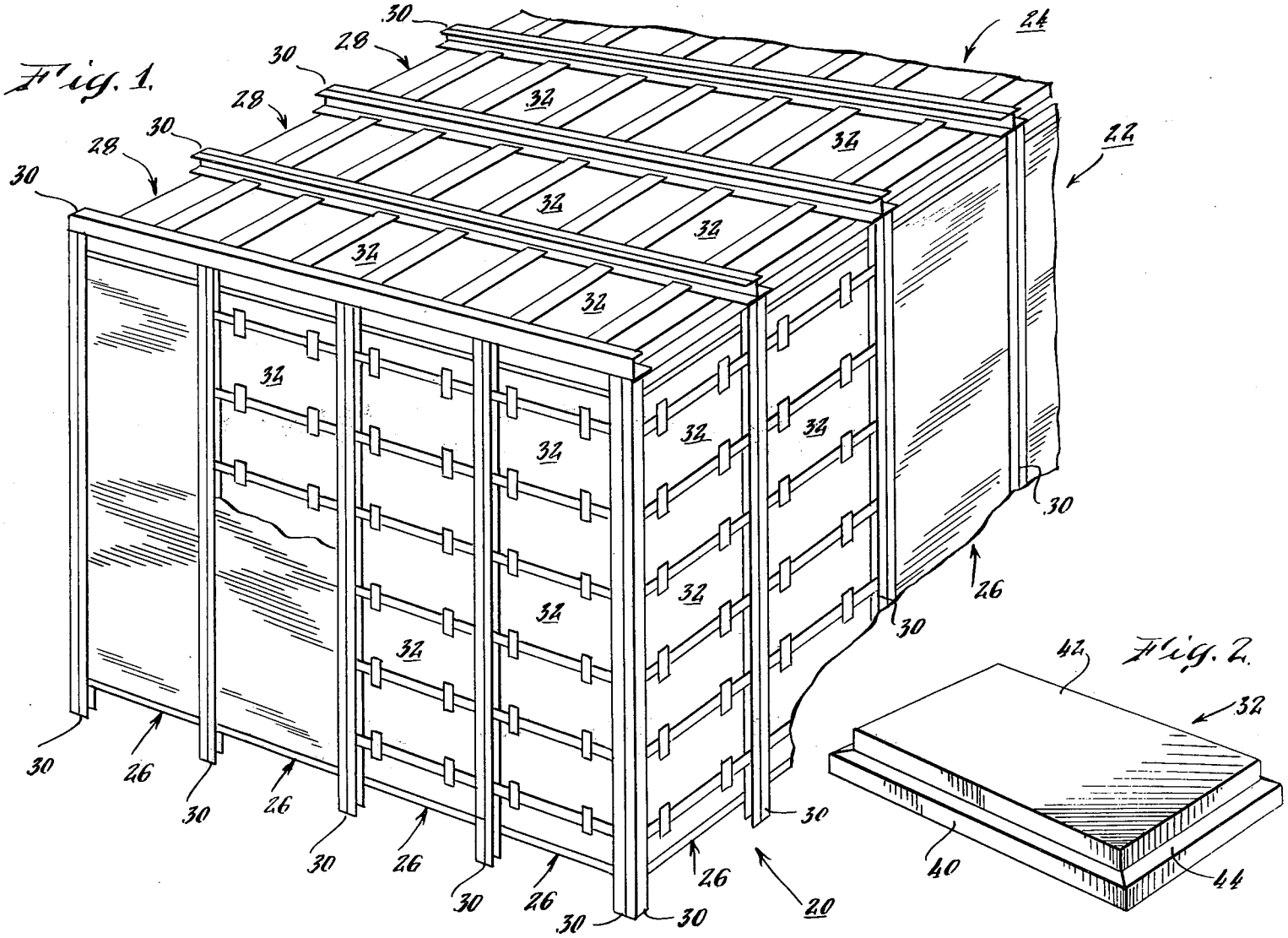
FIG. 1 is a perspective view showing an industrial furnace insulated with lightweight ceramic modules in both its side walls and its roof.
FIG. 2 is a perspective view showing one of the ceramic modules with stepped configuration.

Referring now to FIG. 1, there is shown an industrial furnace 20 with its side walls generally indicated at 22 and its roof generally indicated at 24. The side walls and roof both are formed of side-by-side sets of panels 26 and 28. Each side panel 26 comprises a pair of vertical buck-stays 30 providing rigid support for a stacked group of generally rectangular insulation modules 32 constituted and produced as described hereinabove. Each roof panel 28 similarly comprises horizontal buck-stays 30 from which are suspended a corresponding group of insulation modules 32.

The modules 32 (see also FIG. 2) may be 36" wide by 18" high by 5" deep, with the buck-stays 30 spaced correspondingly. The panels 26 and 28 form the basic standard side wall and roof components for furnaces of various sizes, in multiples of the nominal module width and height (e.g. 36"×18"). Typically these panels are factory assembled and pre-wired. Field erection then merely requires that the panels be bolted together and inter-panel insulation emplaced as described hereinafter. Such an arrangement particularly is advantageous for furnaces too large to be shipped completely factory assembled.

Figure 3:
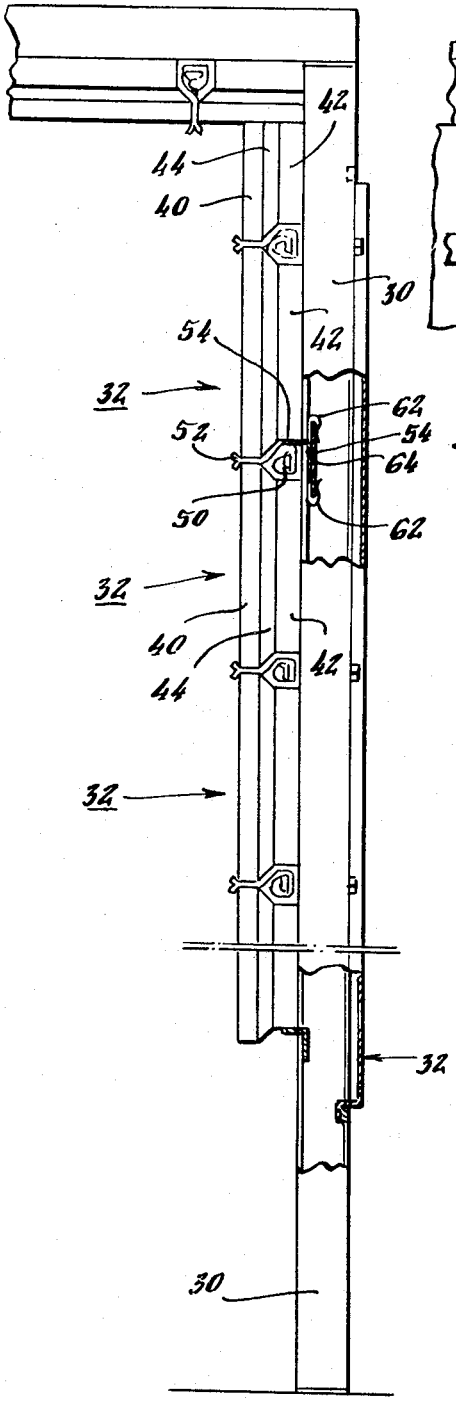
FIG. 3 is a vertical section through the furnace, showing one side wall and part of the roof.
Figure 4:
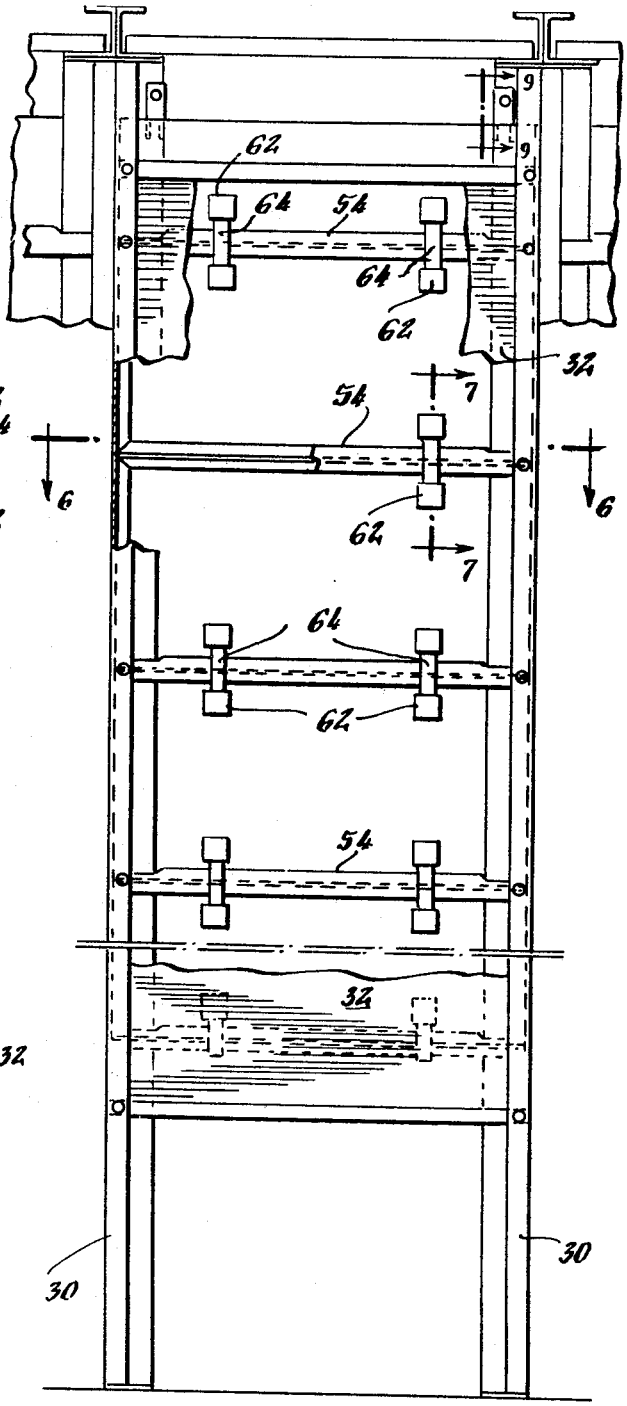
FIG. 4 is an elevation view of one side wall panel, seen from the furnace exterior.

As may be seen particularly in FIGS. 2 and 3, each module 32 is a generally rectangular block presenting a stepped configuration, i.e. it is formed to include a full-sized rectangular inner slab-like section and a set-back outer slab-like section 42 of slightly smaller lateral dimensions defining a rectangular face approximately geometrically similar to that of the inner section 40. The stepped region of joinder between the two sections 40, 42 comprises, in the preferred embodiment, a truncated pyramidal section 44 which provides a taper angle making a generally smooth sloping transition between the two slab-like sections 40 and 42.

The modules 32 are mounted in the panels 26 in side-by-side fashion. The region between adjacent outer sections 42 is filled by a rolled insulation blanket 50 which serves to block off what otherwise would be a high heat-loss channel resulting from a straight through joint. This blanket preferably is formed of inorganic fibrous ceramic material, like that used in the ceramic modules 32, but without binding agents as employed in the liquid slurry used to make the modules rigidly shape-retaining. The blanket thus is sufficiently flexible and compressible so that it can easily be rolled into a relatively tightly compressed shape, as shown in the drawings. Similarly rolled blankets are inserted between the side edges of the outer sections 42 of the ceramic modules in adjacent panels 26.

The rolled blankets 50 are sufficiently resilient so that, after compression and insertion into the regions between the modules 32, the blanket material tends to expand so as to fill the entire adjacent space, thereby to help compensate for slight size variations encountered in production. Also due to their resilient compressibility and springiness, these blankets tend to compensate for the shrinkage in size of the ceramic modules 32 which occurs when the furnace is fired the first few times; that is, blankets resiliently expand to fill the void created by such shrinkage. In accordance with a further aspect of this embodiment, the tails 52 of the rolled blanket are arranged to protrude a small distance (e.g. an inch or so) into the furnace interior. This tail material thus is available subsequently to be stuffed into the parting between the modules, should an intermodule separation of beyond-normal size occur due for example to unusually high furnace temperatures in a given application.

Referring now to FIG. 7, the modules 32 rest on cross-support angle members 54 of inverted L-shape (as seen in cross-section), and so arranged that the flat horizontal surface of each cross-angle member provides support for the outer section 42 of the module immediately above. The cross-support angle members are fastened at their ends to the buck-stays 30 of the corresponding multi-module side wall panel 26.

Inserted into the side edges of the outer (smaller) sections 42 are retainer clips 56 of a stainless steel comprising a heat-resistant alloy and having pairs of sharp prongs or spikes 58, 60 (see also FIG. 8). Spring clasps 62 are integrally formed as part of these retainer clips, and receive and grip under spring tension respective rigid steel lock-bars 64. These lock-bars extend across the corresponding cross-angle member 54 and serve to secure the modules 32 firmly in fixed position horizontally with respect to the cross-angle members. Thus the modules are supported vertically by the cross-angle members, through direct engagement therewith, and are secured horizontally by the retainer clips which interconnect with a cross-angle member by means of the corresponding lock-bar.

The prongs or spikes 58 and 60 of the retainers 56 are offset laterally a substantial distance. Thus the respective planes of the insertion cuts developed by the blade-like spikes are separated a corresponding horizontal distance within the ceramic modules 32. This separation tends to lessen any chance that a split or effective delamination will develop in the ceramic material as a result of stress across the cleavage planes of the spikes.

Because of the extremely high furnace temperatures commonly encountered, e.g. up to 2400° F., there possibly could be degradation of a module retainer due to exposure to high temperatures. However, such a problem is avoided with the present design wherein the prongs 58, 60 are spaced a limited distance in from the outer surface of the module. It has been found that such limited spacing is fully effective in providing desired module retention characteristics, preventing displacement of the module as required for proper furnace performance. Preferably, this spacing between retainer prong and module outer surface should be less than one-half of the module thickness. With the quite steep temperature gradients within the module, the retainer prong, and the adjacent retainer support arm connected thereto, will be at a sufficiently low temperature to prevent damage to the material of the retainer clip.

A further important advantage of the above-described arrangement is that it provides for ready replacement of any of the ceramic modules 32, for example in the event of damage to a module from any cause. To replace a module, the respective locking bars 64 are removed, both at the lower and upper edges of the module. Then the module is pushed inwardly towards the furnace interior, initially sliding along the upper surface of the cross-angle member 54, to a position where it can be grasped from within the furnace interior and removed. Installation of a replacement module follows the reverse procedure.

FIGS. 9 and 10 show another module retainer clip 70 having a pair of symmetrical prongs 72, 74. As shown in FIG. 9, such a retainer clip can be used to secure the upper end (or side) of a ceramic module 76 to the inside surface of the steel shell 78 of a gas-tight furnace. For example, such construction is employed in atmosphere furnaces using combustible gases which protect the work against oxidation, or in material treating such as carburizing or carbo-nitriding. FIG. 13 shows another such retainer clip 80, useful for securing the end or side of a module to a steel shell. Both clips can be fastened to the furnace shell by bolts, by welding, or by explosively-driven fasteners.

FIGS. 11 and 12 show still another retainer clip arrangement 90 for securing to a furnace shell 78 a pair of adjacent ceramic modules 92, 93 of ship-lap configuration, i.e. blocks having complementary offset stepped profiles along their adjoining side edges, to provide for close mating without a straight-through parting line. This retainer 90 is formed with a pair of side-by-side oppositely-extending prongs 94, 95, which pierce the side edges of the respective modules to be embedded therein. The retainer is adapted to be secured to the inner surface of the furnace shell by weldments formed through one or more weld holes 96.

This arrangement provides for rapid assembly of the modules as lining for the furnace, and further provides for secure gripping of the modules to hold them firmly in place. Advantageously, the prongs are supported by separate respective arms 100, 102 which preferably are relativly narrow, thereby to minimize the conduction of heat from the region of the prongs back to the furnace shell.

FIGS. 14–18 illustrate a retainer clip arrangement for holding multiple-layer insulation in place. The application disclosed is for securing insulation blocks to a furnace shell 110, either for new construction, or for re-lining old furnaces. One advantage of multiple-layer insulation arrangements is that relatively inexpensive insulation material, such as vermiculite, can be used for the cooler outer and intermediate blocks as shown at 112, 114, while high-performance but more costly ceramic modules 32 can be used as the hotter inner block where the requirements are more severe. In one particular installation, the outer and intermediate blocks 112, 114 were 2" thick, and the inner module 32 was 5" thick.

Figure 14:
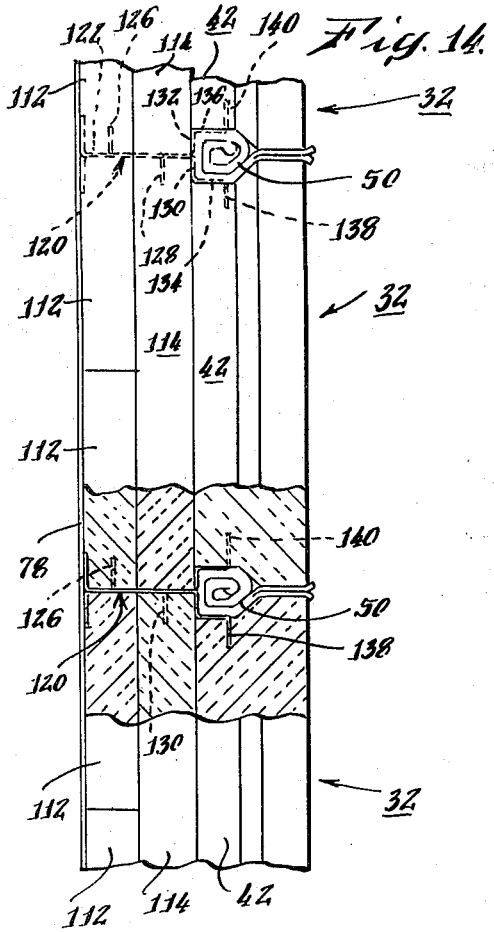
Figure 18:
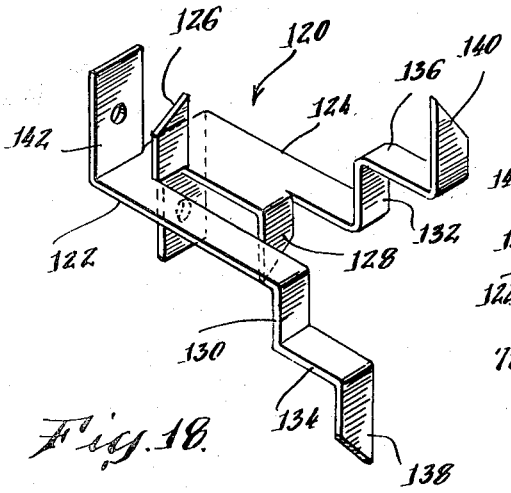

To secure such multiple insulation layers in place, the embodiment of FIG. 14 incorporates a multiple-spike retainer clip 120 (shown in detailed perspective in FIG. 18). Each such clip includes two horizontal support arms 122, 124 extending out between the first vertically-stacked outer insulation blocks 112. At about the horizontal mid-point of this first set of blocks, an upwardly-facing spike 126 is formed by a bent-up half-width portion of one arm 122, and is embedded in the upper outer block 112. At a further horizontal point, a portion of the other arm 124 is formed downwardly into a second spike 128 embedded in the lower intermediate block 114.

The remaining portions of the arms 122, 124 continue horizontally to the inner face of the second stack of blocks 114, where the arms are respectively formed with upwardly and downwardly extending sections 130, 132. These latter sections have at the ends thereof corresponding horizontal sections 134, 136 supporting respective spikes 138, 140 facing up and down respectively. These latter spikes are embedded in the vertically-spaced-apart module sections 42 (generally as in the arrangement of FIG. 7). In the region between the adjacent spaced-apart module sections 42 is a rolled compressed blanket 50, as previously described.

Figure 15:
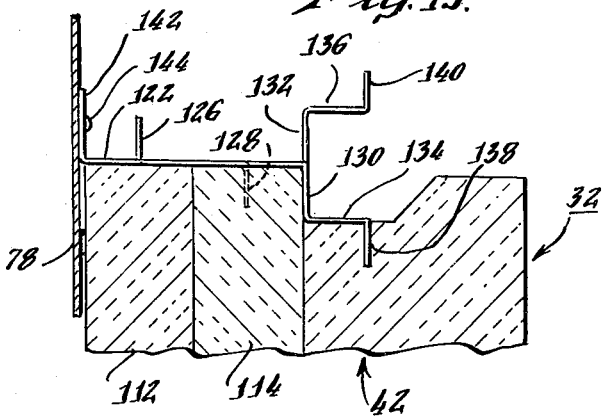
Figure 16:
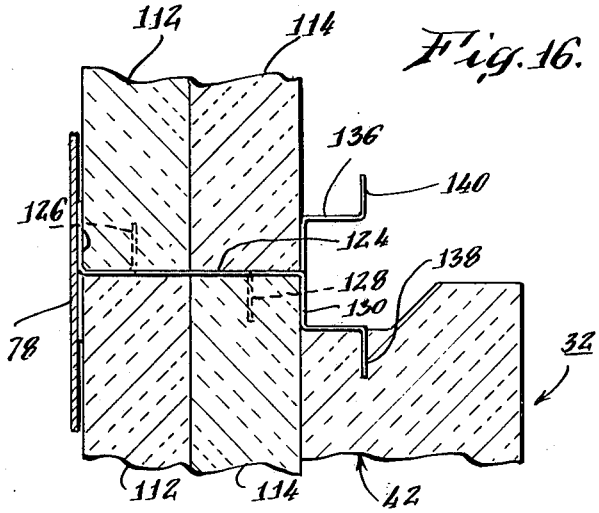
Figure 17:
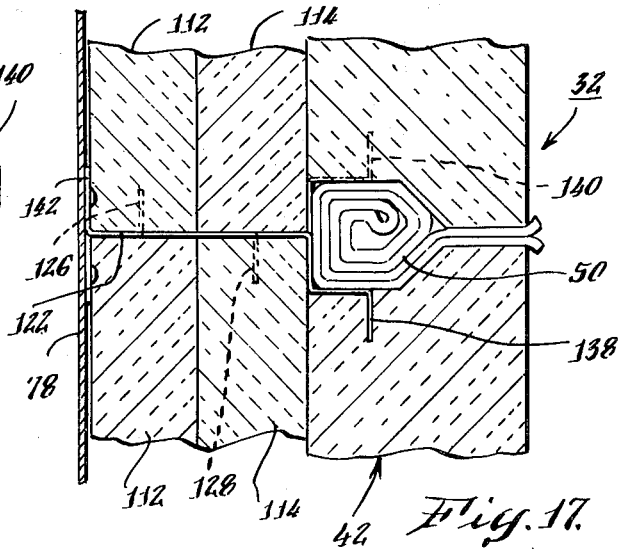

FIGS. 15–17 show the sequence of events in installing the multiple layers of insulation. First, the insulation blocks 112, 144 and the module 32 are placed in position, as by being impaled upon spikes at their lower edges (not shown). The downward spikes of the retainer clip 120 then are inserted into the corresponding block and into the outer module section. The upper portion of the vertical support plate 142 of the retainer then is fastened to the furnace shell 78, as by welding 144 or the like. The upper blocks 112, 114 then are placed in position, with the outer block 112 impaled upon the corresponding upwardly-pointing spike. Then the rolled ceramic blanket 50 is positioned as shown, and the upper module 32 is placed down onto the upwardly facing spike 140. This process then continues with the next higher layer of blocks and modules, and so on.

Although several preferred embodiments have been described hereinabove in detail, it is desired to note that this is for the purpose of illustrating the invention, and should not be considered necessarily limiting of the invention, since it is apparent that those skilled in the art will be able to modify the invention in many ways to meet the requirements of different applications. For example, with reference to the FIG. 14 arrangement, if there is no requirement for the additional insulation blocks 112, 114, the ceramic modules 32 can be secured directly to the furnace shell 78 by retainer clips like that of FIG. 18, but wherein the arms 122, 124 and the associated spikes 126, 128 are omitted. In such a modified retainer, the horizontal arms 134, 136 could connect directly to a vertical-support plate 142 to be fastened to the furnace shell. Still other modifications within the scope of the invention will be apparent to those skilled in this art.

What is claimed is:

1. An industrial furnace used for material heat treatment and the like, comprising:

a plurality of sets of ceramic fiber insulating modules with each set arranged in a vertical stack and disposed to present contiguous aligned surfaces to the furnace interior;

support means comprising rigid elements supporting each of said modules vertically;

a plurality of retainer clip means for said modules;

each of said retainer clip means including at least one sharp spike inserted into the side edge surface of a corresponding module;

each of said retainer clip means further including at least one spike support arm extending horizontally from the corresponding spike to the outer surface of the module, remote from the furnace interior; and means interengaging said spike support arms and said rigid elements to provide for holding the modules securely against horizontal movement.

2. Apparatus as claimed in claim 1, wherein said support means comprises a plurality of horizontally extending but vertically spaced elements for vertically supporting modules in said stack.

3. Apparatus as claimed in claim 2, wherein said retainer clip means comprise sets of two adjacent retainer clips, one for insertion into the lower side edge of one module and the other for insertion into the upper side edge of the next module down;

each such retainer clip further comprising clasp means secured to each spike supporting arm at the outer face of the respective module; and locking means gripped by the clasp means of the two retainer clips of each set and interengaged with the horizontally extending element supporting said one module, whereby to secure the modules to said horizontally extending element.

4. Apparatus as claimed in claim 3, wherein said locking means comprises a locking bar gripped at its ends by the clasp means of the two retainer clips of each set and extending therebetween outwardly of the horizontally extending support element to provide for effecting interengagement therewith.

5. Apparatus as claimed in claim 4, wherein said spike suppot arm extends alongside of the module a horizontal distance limited to less than one-half the module thickness.

6. Apparatus as claimed in claim 1, wherein said retainer clip means each comprises a pair of spike support arms each carrying a spike inserted in a module.

7. Apparatus as claimed in claim 6, wherein said two spikes extend in the same vertical direction and said spike support arms hold the respective spikes at different horizontal distances from the module outer surface.

8. Apparatus as claimed in claim 6, wherein said spike support arms are no wider than the corresponding spike and extend horizontally at such width fully to the outer surface of the module, thereby to minimize heat transfer through the support arms.

9. An industrial furnace used for material heat treatment and the like, comprising:

a plurality of sets of ceramic fiber insulating modules with each set arranged in a vertical stack and disposed to present contiguous aligned surfaces to the furnace interior;

vertically-extending support means for said modules;

a plurality of retainer clip means for said modules;

each of said retainer clip means including at least one sharp spike inserted into the side edge surface of a corresponding module;

each of said retainer clip means further including at least one spike support arm having a section extending horizontally from the corresponding spike to the outer surface of the module which is remote from the furnace interior; and means securing said spike suppot arms to said vertically-extending support means to provide support for holding the modules in position horizontally.

10. Apparatus as claimed in claim 9, wherein said vertically-extending support means comprises a furnace shell;

said horizontally-extending spike support arms being secured to said furnace shell and arranged in pairs with each pair extending between a corresponding pair of vertically-stacked modules.

11. Apparatus as claimed in claim 10, wherein each said retainer clip means comprises a pair of horizontally-extending spike support arms;

one of said pair carrying an upwardly-pointing spike; and the other of said pair carrying a downwardly-pointing spike.

12. Apparatus as claimed in claim 11, including a support plate connected to both arms of each said pair of arms, said support plate being located at a point horizontally outwards of the corresponding pair of modules above and below said pair of support arms;

said support plate being fastened to said furnace shell.

13. Apparatus as claimed in claim 11, wherein the arms of each pair of said horizontal support arms are spaced-apart vertically; and said side edge surfaces of each corresponding pair of vertically-stacked modules are spaced vertically to match the vertical spacing of each said pair of support arms.

14. Apparatus as claimed in claim 13, including a rolled flexible blanket of insulating material positioned in the region between said vertically-spaced side edge surfaces.

15. Apparatus as claimed in claim 9, wherein said securing means comprises an additional section for said support arms extending between said outer module surface and said vertically-extending support means;

each said additional section carrying an additional spike horizontally spaced from said first spike and inserted into the side edge surface of a corresponding additional layer of insulation positioned between the associated one of said modules and said support means.

16. Apparatus as claimed in claim 15, wherein each said retainer clip means comprises two integral spike support arms each having a pair of horizontally-spaced spikes embedded respectively in a corresponding module and an additional layer of insulation located outboard of said module.

17. Apparatus as claimed in claim 15, wherein said vertically-extending support means comprises a furnace shell;

said retainer clip means being secured to said furnace shell.

* * * * *